US007367932B2

(12) United States Patent
Niinai

(10) Patent No.: US 7,367,932 B2
(45) Date of Patent: May 6, 2008

(54) CENTRIFUGE INCLUDING A ROTATING CHAMBER HAVING A BOWL AND A CYLINDER

(75) Inventor: Yoshitaka Niinai, Ibaraki (JP)

(73) Assignee: Hitachi Koki Co., Ltd., Minato-ku, Tokyo (JP)

( * ) Notice: Subject to any disclaimer, the term of this patent is extended or adjusted under 35 U.S.C. 154(b) by 288 days.

(21) Appl. No.: 11/146,139

(22) Filed: Jun. 7, 2005

(65) Prior Publication Data

US 2005/0272587 A1 Dec. 8, 2005

(30) Foreign Application Priority Data

Jun. 8, 2004 (JP) ..... P2004-170583

(51) Int. Cl.
*B04B 5/02* (2006.01)
*B04B 7/06* (2006.01)

(52) U.S. Cl. ..... 494/12; 494/16; 494/60

(58) Field of Classification Search ..... 494/12, 494/16–21, 13–14, 31–34, 43, 60–61, 81, 494/85; 210/360.1
See application file for complete search history.

(56) References Cited

U.S. PATENT DOCUMENTS 5,538,492 A * 7/1996 Potter ..... 494/12
6,196,961 B1 * 3/2001 Hoshiba et al. ..... 494/14
2005/0272587 A1 * 12/2005 Niinai ..... 494/12

FOREIGN PATENT DOCUMENTS

| | | | |
|---|---|---|---|
| CN | 2319125 | | 7/1997 |
| DE | 10233537 A1 | * | 2/2004 |
| JP | 50-56988 | | 5/1975 |
| JP | 3-196856 | * | 8/1991 |
| JP | 2000-492 | * | 1/2000 |

OTHER PUBLICATIONS

Chinese Office Action dated Mar. 30, 2007 with English translation.

* cited by examiner

*Primary Examiner*—Charles E. Cooley
(74) *Attorney, Agent, or Firm*—McGinn IP Law Group, PLLC

(57) ABSTRACT

A structure in which when a rotating member is broken, an impact force is prevented from being concentrated to a local portion by enabling to receive a debris by a wide area at an instant and breaking energy can further be facilitated to consume. Further, according to a centrifuge attached with a cooler, the problem can be achieved to resolve by utilizing an insulating layer at an outer periphery of an evaporator as a space of deforming a guard cylinder when the rotating member is broken.

9 Claims, 5 Drawing Sheets

CENTRIFUGE INCLUDING A ROTATING CHAMBER HAVING A BOWL AND A CYLINDER

BACKGROUND OF THE INVENTION

1. Field of the Invention

The present invention relates to a structure for sealing debris of a rotating member in an apparatus even when the rotating member rotated at high speed is accidentally broken by a centrifugal force as in a centrifuge.

2. Description of the Related Art

A rotating member used for a centrifuge is provided with a test tube hole for mainly holding a test tube inputted with a sample and a user inserts the sample into the hole and rotates the rotating member at high speed and separates the sample having a small mass difference or density difference by operating a centrifugal force to the sample. At this occasion, the centrifugal force is naturally exerted to the rotating member per se, stresses are generated at inner portions thereof and therefore, there is a concern that the rotating member is broken by the centrifugal force in rotating. Therefore, a fabricator executes design having a sufficient allowance therefore including fatigue of a metal by repeated use and except a case by an error in a method of using the rotating member such as an error in an allowable specific weight of the sample or corrosion of the rotating member by a failure in handling a corrosive sample, breakage in previously determined product life may be regarded to be null.

However, a way of thinking that safety of a user needs to be ensured even when breakage which seems to be impossible to be brought about is brought about, has been promoted in recent years, and according to IEC standards 61010-2-020 'Particular requirements for laboratory centrifuges', an accident which seems to bring about the maximum damage is assumed, a test devised to bring about the accident (MCA test: Maximum Credible Accident) is carried out, and it is requested to guarantee to be safe even thereby. Although conditions of the MCA test differ by a kind of a centrifuge and a rotating member used such as seizure of a bearing, breakage of a shaft, separation of a rotating member from the shaft or the like and cannot be specified sweepingly, in many cases, a breakage of a rotating member by a centrifugal force is selected as an accident which brings about the maximum damage. However, as described above, it is difficult to break a rotating member by normally using the rotating member and therefore, a cut groove calculated to break at the maximum rotational speed to which a selected rotating member can reach is worked to a rotating member 3*d* as designated by numeral 14 of FIG. 8A to be broken into two. Further, it is evaluated whether debris can be sealed into a main body, whether a guard member for executing sealing operation is cracked, whether the main body is moved in a predetermined range or the like. Therefore, in order to satisfy the standards, in many cases, it is necessary to constitute the above-described centrifuge which is capable of withstanding breakage. Generally, as shown by FIG. 6, a guard cylinder 13 is arranged at an outer periphery of a bowl 4*b* constituting a rotating chamber 2*b* for rotating a rotating member as a guard member, and is designed such that even when the rotating member is broken and impacted, debris do not break therethrough. Further, in the case of a centrifuge referred to as cooler attached of a type for making a cooling fluid flow on an outer side of a bowl in order to maintain a temperature of a sample to be separated constant, as shown by FIG. 7, in order to prevent wasteful heat input, it is necessary to provide an insulating layer 11*c* on an outer side of a bowl 4*c* and therefore, debris is sealed by providing a guard cylinder 13*c* further on an outer side thereof.

Next, an explanation will be given of a behavior when a rotating member is broken by taking an example of the MCA test in reference to FIGS. 8A, 8B, FIG. 9. As shown by FIG. 8A, the cut groove 14 designed to be broken at a rotatable maximum rotational speed is worked at the rotating member 3*d* which can be used in a centrifuge to be evaluated and is provided with a maximum energy in breaking, and the centrifuge is operated at a predetermined rotational speed to be broken by a centrifugal force. As shown by FIG. 8B, a rotating member debris of the rotating member 3*d* broken in two is provided with a speed component in a tangential direction of a rotational direction and therefore, assuming that the rotating member is broken to separate into two instantaneously by disregarding a behavior of breakage by progress of a crack, respectives thereof are moved radially in arrow mark directions, break through a bowl 4*d* having a thin wall structure and impacted to a guard cylinder 13*d* further on an outer side as shown by FIG. 9. At this occasion, much of rotational energy provided to the rotating member ($E=\frac{1}{2}\times I\times\omega^2$ where I: moment of inertia around axis of rotating member, ω: angular velocity of rotating member) is consumed as local deformation energy and total deformation (deformed into ellipse) energy of the guard cylinder 13*d* and deformation energy of the rotating member debris 15 per se by the impact and is partially consumed also by heat, sound or the like. On the other hand, the above-described speed components in the tangential direction of the rotating member debris 15 produce a couple moment and therefore, there is also a case in which portions of the moment are conducted to the guard cylinder 13*d* or the centrifuge integrated with the guard cylinder 13*d* and a main body of the centrifuge is rotated or moved. Particularly when the guard cylinder 13*d* is significantly deformed to impinge on or bites a frame 10*d* constituting an outer frame of the centrifuge, the force of rotating or moving the main body of the centrifuge is more increased to enhance a danger.

From the above-described, sufficient strength and toughness are requested for the guard cylinder used as the guard member in breaking the rotating member such that the guard cylinder is not cracked even when the rotating member is accidentally broken and the debris is impacted thereto and the guard cylinder is deformed as less as possible. A material thereof differs by the maximum rotational energy of the usable rotating member, normally, in a centrifuge capable of using a rotating member having large energy and having large energy in breaking, a heat treatment steel or a tough hardened steel is used and for a centrifuge capable of only using a rotating member having comparatively small energy, a carbon steel tube which is on sale in place of the heat treatment steel or the tough hardened steel and is inexpensive or the like is adopted and necessary strength is adjusted by pertinently selecting a wall thickness thereof. An air gap between the guard cylinder and the outer frame of the centrifuge is determined in consideration that even when the guard cylinder is deformed by impacting debris in breaking, movement of the centrifuge is sufficiently confined into a predetermined range. Further, as shown by JP-A-50-056988, an inner side of a guard cylinder is installed with a member softer than the guard cylinder, energy is consumed by facilitating to deform when debris is impacted and a time period consumed by energy is prolonged to thereby devise to alleviate impact force.

SUMMARY OF THE INVENTION

According to the centrifuge of the related art, in order to prevent debris from jumping to outside of the centrifuge or prevent the main body of the centrifuge from moving by more than a rectified amount even when the rotating member is broken, it is necessary to adopt the guard cylinder having a thickness sufficiently capable of withstanding impact force when debris is impacted to constitute a factor for making the centrifuge of this kind heavy. Further, when the steel tube on sale is substituted for the guard cylinder needing the heat treatment steel or the tough hardened steel for reducing cost to be equivalent thereto, it is necessary to thicken the wall thickness of the guard cylinder by several times to pose a problem that the product becomes heavier and the size becomes larger. Further, in the case of the centrifuge attached with a cooler, the insulating layer is needed at the outer periphery of the bowl and therefore, it is necessary to provide the guard cylinder on the outer side of the insulating layer to constitute a factor of further enlarging the product. Even in that case, although the centrifuge will do when the guard cylinder matching the size is fabricated by a designated dimension, in the case in which the steel tube is obliged to use in view of cost, it is not guaranteed that a steel tube having an inner diameter size matching an outer diameter of the insulating layer is on sale, frequently, a larger steel tube is adopted to thereby pose a problem that the product becomes heavier and heavier and the size becomes larger and larger. On the other hand, although the structure of installing the soft guard member in the guard cylinder is excellent in view of absorbing energy, there is a difficulty that cost is increased since the soft guard member is extraneously needed and also the main body size is enlarged.

The invention has been carried out in view of the above-described drawback. It is an object of the invention to provide a centrifuge which can sufficiently seal breakage of the rotating member and is light-weighted and particularly reduce a size of a main body of a centrifuge attached with a cooler.

The above-described object is achieved by knitting a wire member of a steel wire, a stainless steel wire or the like in a mesh-like shape to form in a cylindrical shape to use in place of a metal cylinder generally used in this kind of a centrifuge as a guard cylinder. Further, in the case of a centrifuge attached with a cooler, by utilizing an insulating layer, a size of a main body thereof can further be downsized.

According to one aspect of the invention, when a rotating member is accidentally broken, the guard cylinder in a mesh structure (in a cylindrical shape constituted by knitting a slender wire in a mesh-like shape) is adopted in place of the guard cylinder made of a metal used for sealing a debris including a debris of the rotating member in the centrifuge and therefore, the centrifuge of this kind can be light-weighted. Further, in the centrifuge attached with the cooler, the guard cylinder can be integrated into the insulating layer disposed at the outer periphery of the bowl (evaporator) wound with the cooling pipe and therefore, further small-sized and light-weighted formation can be achieved in comparison with the centrifuge of the related art which needs the guard cylinder at the outer periphery of the insulating layer.

According to another aspect of the invention, there is provided with a centrifuge including: a rotating member and operable to put a sample; a drive device rotating the rotating member at a predetermined speed; a rotating chamber including: a bowl having on an outer periphery thereof a cylinder formed by knitting a wire member into a net; and an opening portion bringing in and out the rotating member, and a member closing the opening portion of the rotating chamber when the rotating member is being rotated.

According to another aspect of the invention, there is provided with a centrifuge including: a rotating member and operable to put a sample; a drive device rotating the rotating member at a predetermined speed; a rotating chamber including a bowl and an opening portion bringing in and out the rotating member; a member closing the opening portion of the rotating chamber when the rotating member is being rotated; an insulating member provided at the outer periphery of the bowl, and the insulating member having therein a cylinder formed by knitting a wire member into a net; a pipe wound around the outer periphery of the bowl; and a cooling device making a cooling fluid flow in the pipe.

DESCRIPTION OF THE PREFERRED EMBODIMENTS

Figure 1:
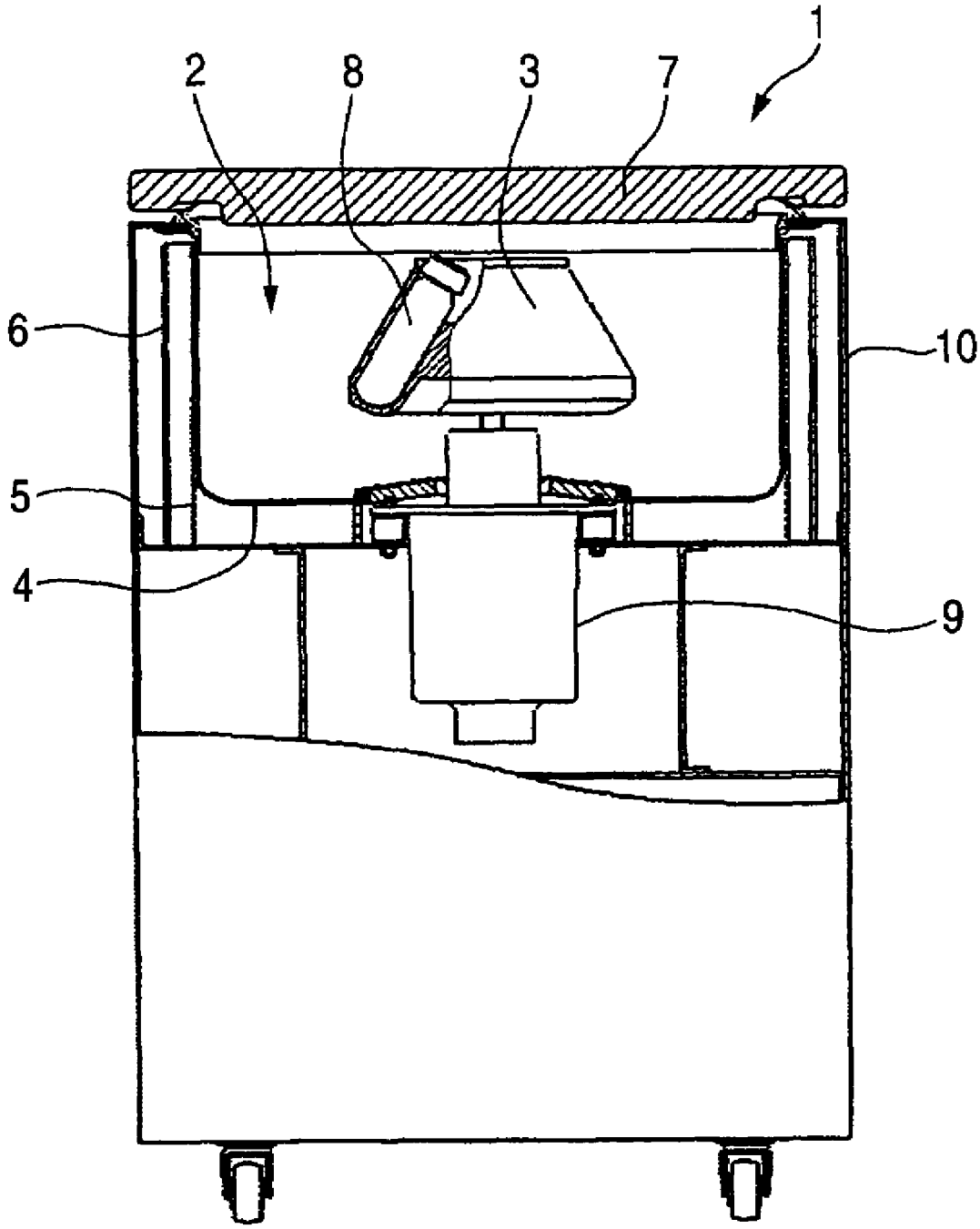
FIG. 1 is a partial-cross sectional view showing a centrifuge arranged with a guard cylinder at an outer periphery of a bowl according to a first embodiment of the invention.
Figure 2:
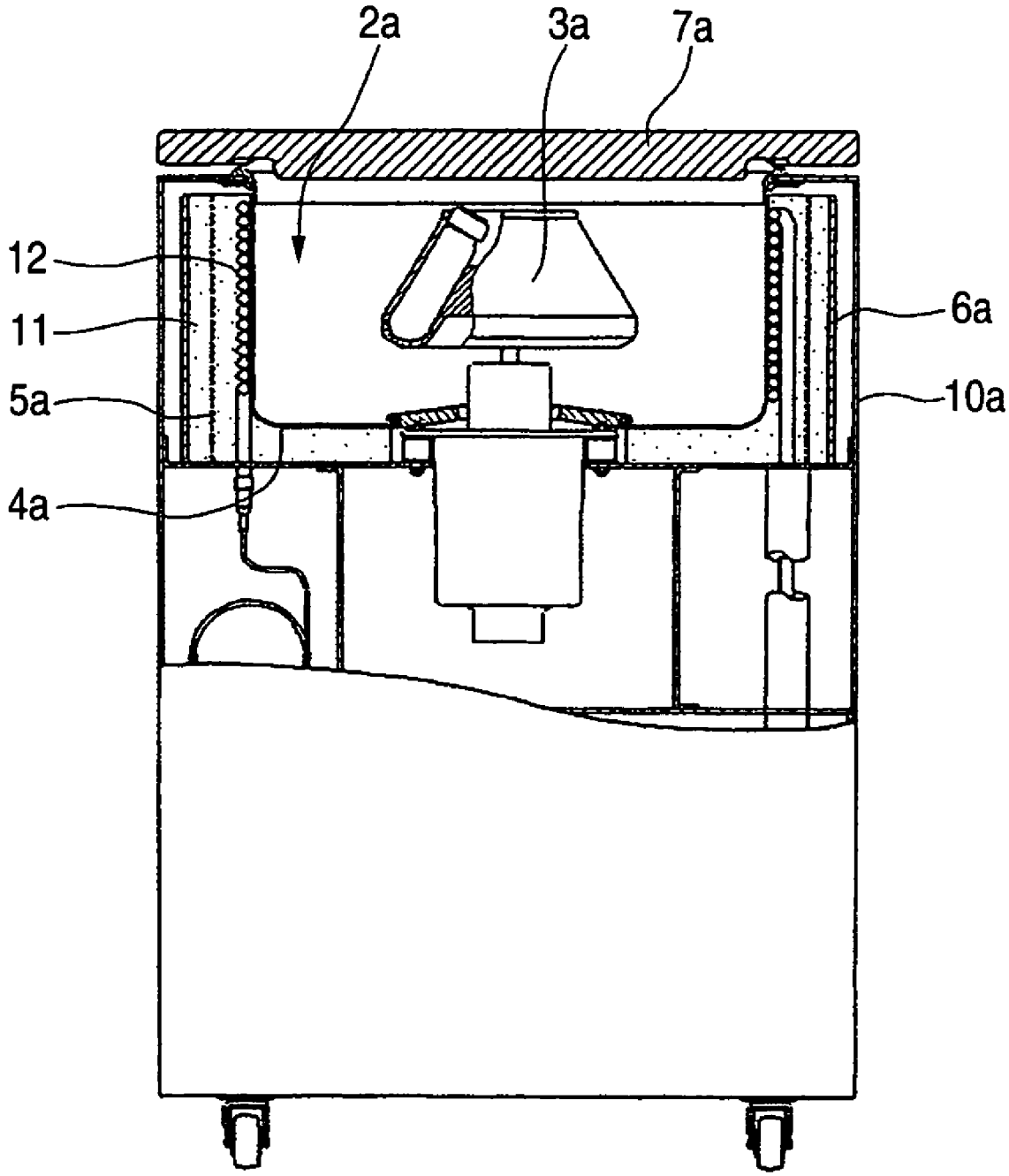
FIG. 2 is a partial-cross sectional view showing a centrifuge attached with a cooler according to a second embodiment of the invention.
Figure 3:
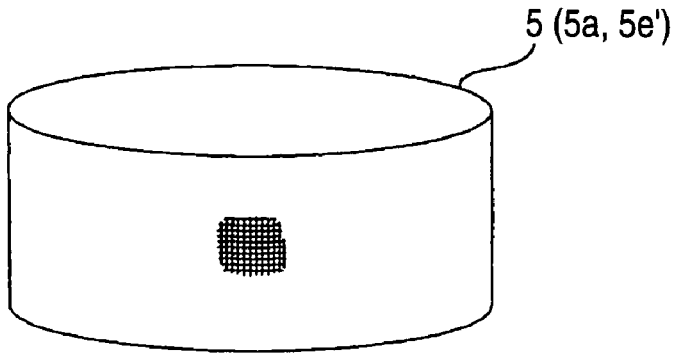
FIG. 3 is a perspective view showing an outlook of a guard cylinder according to the embodiments of the invention.
Figure 4:
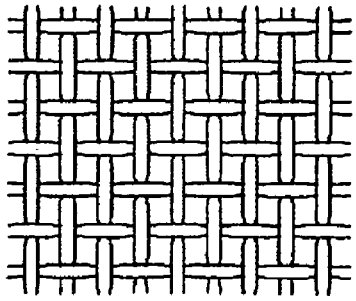
FIG. 4 is an enlarged outlook view for explaining a mesh of a guard cylinder according to the embodiments of the invention.
Figure 5:
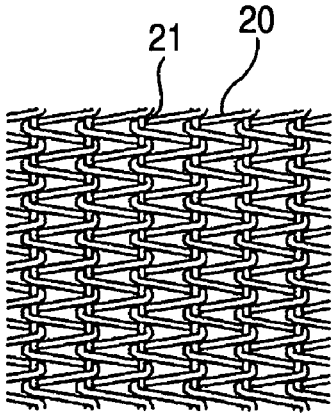
FIG. 5 is an enlarged outlook view for explaining other mesh of a guard cylinder according to the embodiments of the invention.
Figure 6:
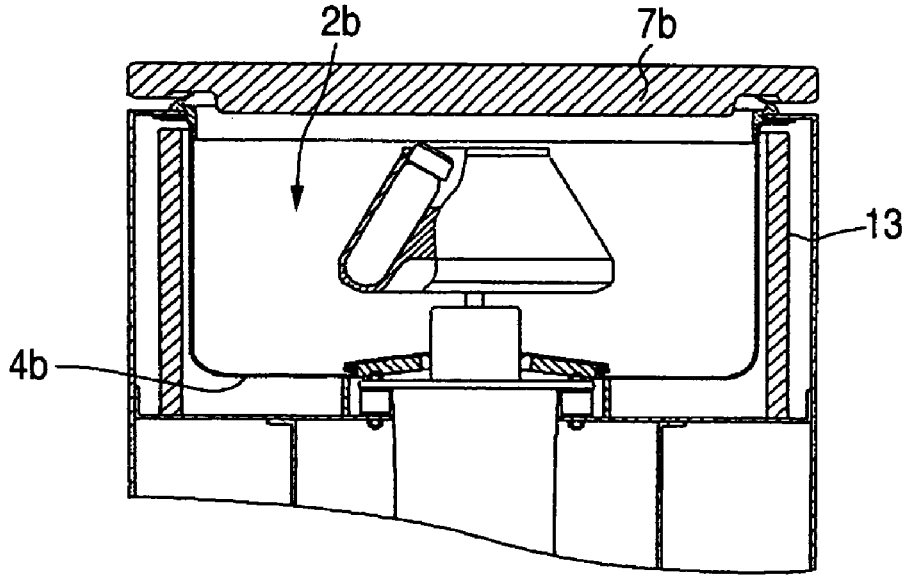
FIG. 6 is a view showing a centrifuge according to a related art as a partially sectional view.
Figure 7:
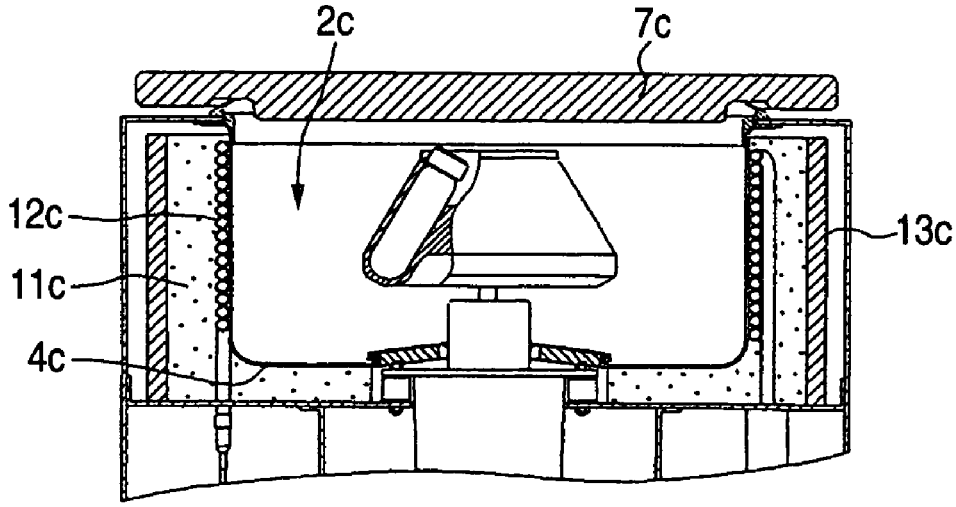
FIG. 7 is a view showing a centrifuge attached with a cooler according to a related art as a partially sectional view.
Figure 8A:
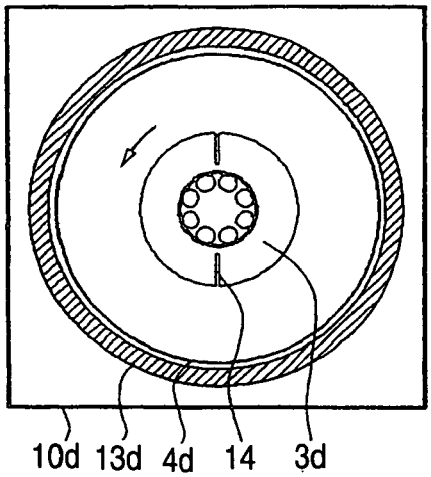
FIGS. 8A and 8B illustrate explanatory views viewed by removing a door portion for hermetically closing a rotating chamber from an upper face of the rotating chamber worked with a groove at a rotating member for explaining a behavior of a debris when broken by a centrifugal force.
Figure 8B:
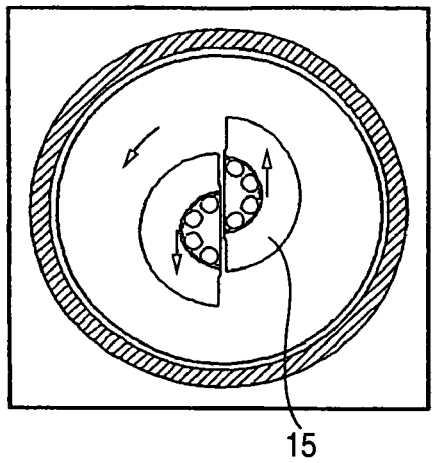
Figure 9:
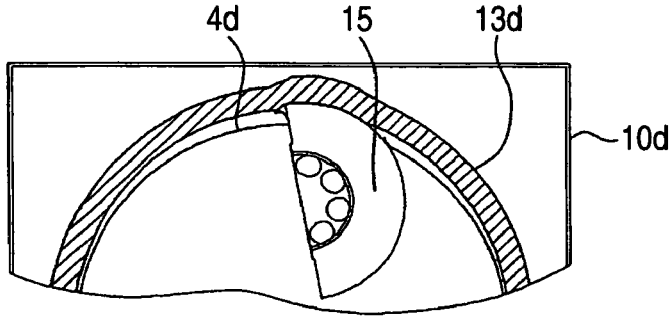
FIG. 9 is a view for explaining a behavior of a centrifuge according to a related art when a rotating member is broken and a rotating member debris is impacted to a guard cylinder.
Figure 10:
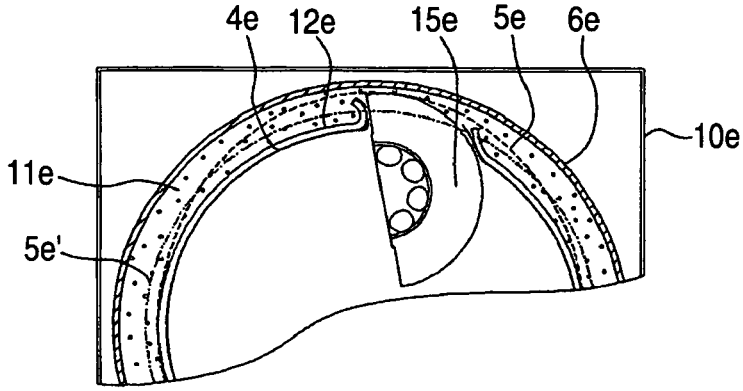
FIG. 10 is a view for explaining a behavior of a centrifuge attached with a cooler according to the second embodiment when a rotating member is broken and a rotating member debris is impacted to a mesh-like guard cylinder.

FIG. 1 shows an first embodiment of a centrifuge arranged with a guard cylinder according to the invention at an outer periphery of a bowl by a partially sectional view. FIG. 2 shows a centrifuge of the second embodiment which is attached with a cooler similarly as a partially sectional view. FIG. 3 is a perspective view showing an outlook of a guard cylinder according to the embodiments. FIGS. 4, 5 are enlarged outlook views for explaining a mesh of a guard cylinder according to the embodiments of the invention. FIG. 6 shows a centrifuge according to a related art as a partially sectional view. FIG. 7 shows a centrifuge attached with a cooler according to a related art as a partially sectional view. FIGS. 8A and 8B illustrate explanatory views viewed by removing a door portion for hermetically closing a rotating chamber shown from an upper face of the rotating chamber worked with a groove at a rotating member for explaining a behavior of debris when broken by a centrifugal force. FIG. 9 shows a view for explaining a behavior of a centrifuge according to a related art when a rotating member is broken and a rotating member debris 15 is impacted to a guard cylinder. FIG. 10 shows a view for explaining a behavior of a centrifuge attached with a cooler according to the invention when a rotating member is destructed and a rotating member debris 15*e* is impacted to a mesh-like guard cylinder.

A centrifuge according to the first embodiment of the invention will be explained in reference to FIG. 1. An output shaft (not illustrated) of a drive device 9 is projected into a rotating chamber 2 of a centrifuge 1, a rotating member 3 inserted with a sample 8 is mounted to the output shaft and is rotated at high speed to thereby subject the sample 8 to centrifugal operation. An upper opening portion of the rotating chamber 2 is provided with an openable and closable door 7 and is provided with a door lock (not illustrated) for locking the door 7 such that a user cannot touch the rotating member 3 by the hand in rotating the rotating member 3 and the door 7 is controlled by a controller (similarly not illustrated) Further, the door lock is designed such that even when the rotating member 3 or debris thereof impinges on the door 7, the door 7 is not opened and a locked state can be maintained when the rotating member 3 is accidentally detached or separated from the output shaft or when the rotating member 3 is broken.

Further, a bowl 4 of the rotating chamber 2 is formed into a bottomed thin plate without recesses and projections at an inner surface thereof such that wind loss by rotating the rotating member 3 is reduced, or, for example, a user dealing with a pathogenic sample is easy to wipe for sterilizing or cleaning by pressing or spinning and as a material therefore, a thin plate of stainless steel, aluminum, or copper is generally used. Further, an outer peripheral portion of the bowl 4 is installed with a mesh-like guard cylinder 5 in a shape of a metal net knitted in a cylindrical shape by stainless steel wires or steel wires, and an outer periphery thereof is provided with an auxiliary guard cylinder 6 with a predetermined space therebetween.

When the rotating member 3 of FIG. 1 is broken as shown by FIG. 8B, the rotating member debris impinges on the bowl 4, since the bowl 4 is thin-walled, the rotating member debris breaks therethrough to crash to the mesh-like guard cylinder 5, since the mesh-like guard cylinder 5 is an aggregation of comparatively slender wire members, the impacted portion is deformed by following a shape of the rotating member debris and therefore, a load thereof can be received by a wide area, further, since the wire members forming the net rub each other at a number of portions thereof to deform while consuming energy, an energy consuming time period can be prolonged and the impact force can considerably be alleviated. Further, a total of the mesh-like guard cylinder 5 becomes a shape of an elliptical cylinder by the crash, and a portion disposed on a side of a short diameter of an ellipse tightens to deform the bowl 4 to further consume energy. Further, the wire member of the mesh-like guard cylinder 5 may not be constructed by a constitution of a shape of a single piece of a wire but may be constructed by a constitution in a shape of a rope of a wire rope or the like.

Meanwhile, the centrifuge of the related art needs to adopt the thick-walled metal-made guard cylinder 13, 13*d* since an impulsive load is applied to a local portion as shown by FIG. 6, FIG. 9 such that even when one point concentrated load is operated, the deformation is retained to a rectified deformation so as not to be effected on the frame 10*d*, conversely, the energy is consumed in a short period of time thereby, a strong impact force is generated and therefore, it is also necessary to reinforce a structure thereof to be able to withstand the impact force.

Therefore, according to the first embodiment, the light-weighted and thin-walled mesh-like guard cylinder 5 can sufficiently substitute for the thick-walled metal-made guard cylinder. Further, a number of folds of twofold or threefold of the mesh-like guard cylinder 5 may be provided.

Further, when the mesh-like guard cylinder 5 is provided with the auxiliary guard cylinder 6 constituted by rolling a thin plate, a slender debris passing through the mesh can be received (owing to slender debris, the energy of receiving the debris is small), and an effect of sealing the debris in the centrifuge 1 is further promoted. However, depending on a size of the mesh or the energy of the rotating member 3, a function thereof can also be substituted for by a frame 10 without using the auxiliary guard cylinder 6.

Next, a centrifuge attached with a cooler according to a second embodiment will be explained in reference to FIG. 2.

An evaporator is wound by a cooling pipe 12 at an outer periphery of a bowl 4*a* to be brought into close contact therewith in order to maintain a temperature of a rotating member 3*a* a temperature of which rises when the rotating member 3*a* is as it is by wind loss by rotation, making a cold medium flow in the cooling pipe 12 by using a refrigerator (not illustrated) and having a function of cooling the rotating member 3*a* by lowering a temperature of the bowl 4*a* and therefore, a temperature of a rotating chamber 2*a*.

Therefore, it is preferable that the bowl 4*a* is made of stainless steel having a small thermal capacity, strong against corrosion and thin-walled. Further, it is preferable to maintain the temperature of the rotating member 3*a* constant by measuring the temperature of the rotating chamber 2*a* having a correlation with the temperature of the rotating member 3*a* by a thermister or the like (not illustrated) and making the refrigerator ON-OFF by a controller (not illustrated). Further, there also is a method of maintaining the rotating member 3*a* at the constant temperature by controlling the temperature of the bowl 4*a* by making cooling water flow in place of the refrigerator, or using electronic cooling by a Peltier element. In any of the methods, an outer peripheral face of the bowl 4*a* is provided with an insulating layer 11 by filling foamed polyurethane according to the example, integrating a product molded by foamed styrene, or pasting an insulating foamed sheet of an independent foamed species in order to prevent extra heat input or condensation except a centrifuge of a type referred to as ultra centrifuge and arranged with the bowl 4*a* in a vacuum tank.

According to the second embodiment of the invention, a mesh-like guard cylinder 5*a* similar to that of the first embodiment is embedded into the insulating layer 11, particularly in the case of heat insulation by filling foamed polyurethane as in the example, since the cylinder is constituted by the mesh, a foaming solution easily passes through the mesh and therefore, the foaming solution can sufficiently spread to corners. And in the case of the molded product of foamed styrene or pasting the foamed sheet, by a double structure, the mesh-like guard cylinder 5*a* can be provided therebetween. Meanwhile, although since the mesh-like guard cylinder 5*a* is provided at a portion proximate to the cooling pipe 12, there is a case in which a thickness of the insulating layer becomes deficient, heat is inputted from the mesh-like guard cylinder 5*a* to the bowl 4*a*, or conversely, a hindrance of warming the bowl 4*a* is constituted, since the material comprises the metal net, a thermal capacity thereof is smaller than that of the metal tube and an influence thereby is slight.

When the rotating member 3*a* is broken in the structure, similar to the above-described, as shown by FIG. 10, a rotating member debris 15*e* breaks through a bowl 4*e* having a low strength and a cooling pipe 12*e* including a copper tube to be impacted to a mesh-like guard cylinder 5*e*. At this occasion, an insulating layer 11*e* can be regarded to be similar to air with regard to impact and deformation. Further, since the procedure of consuming energy is similar to the above-described, the light-weighted and thin-walled mesh-like guard cylinder 5*e* can similarly substitute for the thick-walled metal-made guard cylinder. Further, what is to be mentioned specially here resides in that the insulating layer 11*e* can serve also as a space of deforming the mesh-like guard cylinder 5*e* and even when the rotating member debris 15*e* is penetrated into the mesh-like guard cylinder 5*e*, deformation of the mesh-like guard cylinder 5*e* can be retained in the insulating layer 11*e*.

That is, in comparison with the centrifuge according to the related art in which as shown by FIG. 7, the thick-walled guard cylinder 13*c* is arranged at the outer peripheral portion of the insulating layer 11*c* and a sufficient air gap is further needed at the outer periphery, small-sized and light-weighted formation can be achieved. Further, when the outer periphery of the insulating layer 11 is provided with the auxiliary guard cylinder 6 constituted by rolling a thin plate similar to the first embodiment, a slender debris passing through the mesh, (owing to slender debris, energy therefore is small) or debris of the insulating layer 11 can be received and the effect of sealing the debris in the centrifuge can further be achieved. However, depending on the size of the mesh or the energy of the rotating member, the function of the auxiliary guard cylinder 6*a* can be substituted for by a frame 10*a* without using the auxiliary guard cylinder 6*a*.

Next, the mesh-like guard cylinder according to the invention will be explained in reference to FIG. 3, FIG. 4, FIG. 5. As shown by FIG. 3, the mesh-like guard cylinder is knitted by slender metal wires without a break in an axial direction and a way of knitting the mesh-like guard cylinder is selected by energy of the rotating member. When an example is taken, there is plain weave as shown by FIG. 4, or a belt-like shape in which wire members 20 having a wavy shape are connected by wire members 21 as shown by FIG. 5. As the metal wire member used, a material which is optimum for the energy of the rotating member such as a general stainless steel wire, a stainless steel wire of a spring, a piano wire or the like is selected.

Further, a constitution in a rope-like shape of a wire rope or the like will do in place of a metal wire member, further, a similar effect can be expected by a cylinder in a cloth-like shape woven by a high strength fiber of aramide fiber, carbon fiber or the like, and depending on cases, further small-sized and light-weighted formation of the main body of the centrifuge can be achieved and also an influence on cooling can further be alleviated. Further, a metal net made of a metal knitted in a sheet-like shape or cloth of a reinforced fiber may be worked in a shape of a cylinder (circular cylinder) by using welding, a fastening metal piece, an adhering agent or the like.

What is claimed is:

1. A centrifuge comprising:

a frame;

a motor disposed in the frame to generate a driving force;

a bowl that is disposed in the frame and defines a rotor chamber;

a rotor disposed in the rotor chamber and connected with an output shaft of the motor, the rotor being adapted to hold a sample; and a mesh-like guard cylinder disposed at an outer peripheral portion of the bowl, the guard cylinder being in a shape of a net knitted in a cylindrical shape by a wire member.

2. The centrifuge according to claim 1, wherein the bowl comprises a thin plate comprising at least one of stainless steel, aluminum, and copper.

3. The centrifuge according to claim 1, wherein the wire comprises at least one of a metal wire comprising at least one of a steel and a stainless steel and a fiber comprising at least one of aramide fiber and a carbon fiber, and wherein the cylinder comprises at least one of a metal net and a cloth.

4. A centrifuge comprising:

a frame;

a motor disposed in the frame to generate a driving force;

a bowl that is disposed in the frame and defines a rotor chamber;

a rotor disposed in the rotor chamber and connected with an output shaft of the motor, the rotor being adapted to hold a sample;

a first guard cylinder disposed at an outer peripheral portion of the bowl, the first guard cylinder being in a shape of a net knitted in a cylindrical shape by a wire member; and a second guard cylinder comprising a thin plate that is disposed between the frame and the first guard cylinder so that a slender debris passing through the net of the first guard cylinder can be received by the second guard cylinder.

5. A centrifuge comprising:

a frame;

a motor disposed in the frame to generate a driving force;

a bowl that is disposed in the frame and defines a rotor chamber;

a rotor disposed in the rotor chamber and connected with an output shaft of the motor, the rotor being adapted to hold a sample;

an insulating layer formed on an outer peripheral face of the bowl;

a first guard cylinder embedded in the insulating layer and disposed at the outer peripheral portion of the bowl, the first guard cylinder being in a shape of a net knitted in a cylindrical shape by a wire member; and a second guard cylinder comprising a thin plate that is disposed at the outer periphery of the insulating layer so that a slender debris passing through the net of the first guard cylinder can be received by the second guard cylinder.

6. The centrifuge as defined in claim 5, wherein a pipe is wound around the outer periphery of the bowl and a cooling device is provided to make a cooling fluid flow in the pipe.

7. The centrifuge according to claim 6, wherein the cooling device comprises a refrigerator circulating a cold medium including flon gas.

8. The centrifuge according to claim 6, wherein the pipe contacts the bowl.

9. The centrifuge according to claim 5, wherein the wire comprises at least one of a metal wire comprising at least one of a steel and a stainless steel and a fiber comprising at least one of aramide fiber and a carbon fiber, and wherein the cylinder comprises at least one of a metal net and a cloth.

* * * * *